United States Patent [19]

Yamamoto et al.

[11] Patent Number: 4,528,046

[45] Date of Patent: Jul. 9, 1985

[54] METHOD OF MANUFACTURING AUSTENITIC STAINLESS STEEL PLATES

[75] Inventors: Sadahiro Yamamoto; Chiaki Ouchi, both of Yokohama, Japan

[73] Assignee: Nippon Kokan Kabushiki Kaisha, Tokyo, Japan

[21] Appl. No.: 630,085

[22] Filed: Jul. 12, 1984

[30] Foreign Application Priority Data

Jul. 22, 1983 [JP] Japan ..... 58-132921

[51] Int. Cl.[3] ..... C22C 37/00

[52] U.S. Cl. ..... 148/12 E; 75/123 N; 75/123 J; 75/123 K

[58] Field of Search ..... 148/12 E

[56] References Cited

FOREIGN PATENT DOCUMENTS

| | | | |
|---|---|---|---|
| 56-21053 | 5/1981 | Japan | 148/12 E |
| 57-104628 | 6/1982 | Japan | 148/12 E |
| 1025744 | 6/1983 | U.S.S.R. | 148/12 E |

*Primary Examiner*—Veronica O'Keefe

*Attorney, Agent, or Firm*—Frishauf, Holtz, Goodman & Woodward

[57] ABSTRACT

An austenitic stainless steel plate containing up to 0.08 wt. % of carbon, up to 1.0 wt. % of silicon, up to 2.0 wt. % of manganese, 8.0–16.0 wt. % of nickel, 16.0–20.0 wt. % of chromium, 0–30 wt. % of molybdenum, up to 0.25 wt. % of nitrogen and the balance of iron and inherent impurities, is manufactured by rolling a stainless steel blank at a temperature higher than $T_R(°C.)=940+30(\%Mo)$, and then cooling the rolled blank from a temperature above 800° C. to a temperature below 500° C. at a cooling speed higher than Rc (°C./sec.) shown by the following equations:

$$\log(Rc)=-0.32+14(\%C+\%N)-0.067(\%Mo)$$

when $(\%C+\%N)\leqq 1.0$ wt. %; and $$\log(Rc)=1.08-0.067(\%Mo)$$

when $(\%C+\%N)>1.0$ wt. %.

1 Claim, 3 Drawing Figures

METHOD OF MANUFACTURING AUSTENITIC STAINLESS STEEL PLATES

BACKGROUND OF THE INVENTION

This invention relates to a method of manufacturing austenitic stainless steel plates.

As is well known in the art, stainless steel has excellent corrosion proofness and heat resistant property, and depending upon its composition it is classified into austenite type, ferrite type and duplex of austenite and ferrite. Of these types, most of the stainless steels are limited to SUS 304 and 316 which are of the austenite type. These types of austenitic stainless steel are used as corrosion resistant material, heat resistant material, structural nonmagnetic plates, and low temperature steel plates. In recent years, these steels are used as clad steel in combination with low alloy steel.

In the prior art, it has been recognized that the austenitic stainless steel is subjected to a solution treatment. The purpose of this treatment is (1) to completely convert carbide and nitride into a solid solution and then to quench so that the carbide and nitride would not precipitate during succeeding cooling step, and (2) to eliminate strain and nonuniform structure caused by hot rolling. However, the solution treatment is not suitable to save energy because the solution treatment requires reheating and quenching on the outside of a production line. Moreover, a range in which thick plate can be manufactured is limited due to heat treatment furnace. Furthermore, SUS 304 and 316 have low yield strength which limits the range of use of thick stainless steel plates as structural materials.

Regarding SUS 304 and 316, for the purpose of widening the range of use, the quantities of additional elements have been increased which have suceeded to increase more or less the strength, but this measure increases manufacturing cost so that it does not provide fundamental solution.

SUMMARY OF THE INVENTION

It is an object of this invention to provide an improved method of manufacturing austenitic stainless steel plates capable of saving much more energy than the prior art solid solution treatment method and yet producing superior products.

According to this invention there is provided a method of manufacturing austenitic stainless steel plates containing up to 0.08 wt. % of carbon, up to 1.0 wt. % of silicon, up to 2.0 wt. % of manganese, 8.0–16.0 wt. % of nickel, 16.0–20.0 wt. % of chromium, 0–3.0 wt. % of molybdenum, up to 0.25 wt. % of nitrogen and the balance of iron and inherent impurities, characterized in that the method comprises the steps of rolling a stainless steel blank at a temperature higher than $T_R=940+30(\%\ Mo)$ °C., and then cooling the rolled blank from a temperature above 800° C. to a temperature below 500° C. at a cooling speed higher than Rc (°C./sec) shown by the following equations:

$$\log(Rc)=-0.32+14(\%\ C+\%\ N)-0.067(\%\ Mo)$$

where $(\%\ C+\%\ N)\leqq 0.1\%$; and $$\log(Rc)=1.08-0.067(\%\ Mo)$$

where $(\%\ C+\%\ N)>0.1\%$.

BRIEF DESCRIPTION OF THE DRAWINGS

The foregoing and further objects and advantages of the invention can be fully understood from the following detailed description when read in conjunction with the accompanying drawings in which.

DESCRIPTION OF THE PREFERRED EMBODIMENT

Recent advancement of the heat treatment technique in the manufacture of steel is remarkable. For example, rolling technique causing less quality variation has been developed, and regarding heating and cooling of steel plates which have been performed on the outside of the production line, as disclosed in the method of cooling steel plates disclosed in Japanese Patent Publication No. 61415/1976, a technique or installation has been established in which steel plates are subjected to accelerated cooling on line after hot rolling. Based on these technique, we have investigated heat treatment of austenitic stainless steel and succeeded to solve problems encountered at the time of the solid solution treatment by rolling stainless steel in a $\gamma$ recrystallization range to improve the yielding strength, and by rapidly cooling on line the stainless steel at a cooling speed higher than a critical speed in a specific temperature range after rolling so as to limit precipitation of carbide and nitride of Cr.

Figure 1:
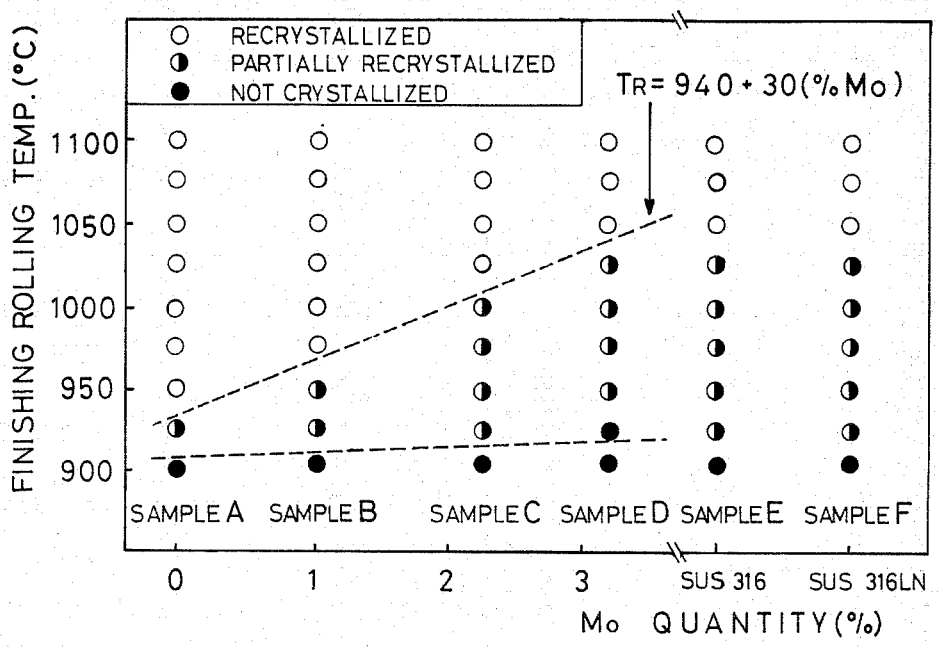
FIG. 1 is a table showing the relationship between the finishing rolling temperature and the structure of SUS 304 steel in which the quantity of Mo in SUS 316 and SUS 316LN steels and the finishing rolling temperature are varied.

More particularly, for the purpose of rendering the structure to have fine and uniform particles by recrystallization, we have investigated the performance of recrystallization and found that the performance of recrystallization is principally governed by $\gamma$ diameter at the early stage, reduction rate, temperature and chemical composition. FIG. 1 shows the relation between the finishing rolling temperature and the structure of SUS 304 steel incorporated with up to 3.2 wt. % of Mo (A–D), SUS 316 (E) and SUS 316LN (F) having composition as shown in the following Table I which are heated to 1200° C., rolled to 12 mm thickness by varying finishing rolling temperature, and then cooled.

TABLE I

| | COMPOSITION OF TEST STEEL | | | | | | | | | |
|---|---|---|---|---|---|---|---|---|---|---|
| | C | Si | Mn | P | S | Ni | Cr | Mo | sol. Al | TN |
| A | 0.051 | 0.66 | 1.76 | 0.020 | 0.011 | 8.7 | 18.5 | — | 0.001 | 0.0166 |
| B | 0.050 | 0.62 | 1.68 | 0.020 | 0.010 | 8.5 | 18.1 | 1.0 | 0.001 | 0.0176 |
| C | 0.053 | 0.64 | 1.68 | 0.018 | 0.010 | 8.7 | 18.3 | 2.3 | 0.001 | 0.0163 |
| D | 0.050 | 0.63 | 1.73 | 0.015 | 0.011 | 8.9 | 18.0 | 3.2 | 0.001 | 0.0172 |
| E | 0.068 | 0.65 | 1.64 | 0.019 | 0.008 | 12.0 | 16.5 | 2.3 | 0.001 | 0.0196 |
| F | 0.024 | 0.40 | 1.13 | 0.015 | 0.011 | 11.5 | 17.4 | 2.3 | 0.001 | 0.193 |

In the tests, by considering the actual rolling operation, the reduction rate per pass was selected to be 10–20% so that in the experiments, among the factors that have an influence upon the recrystallization, temperature and chemical composition are variable factors. As can be noted from FIG. 1 as the quantity of Mo contained in SUS 304 (sample A), the finishing rolling temperature necessary for perfect recrystallization increases. However, in samples C, E and F, their recrystallization performances are nearly equal while the quantity of Mo is the same but the quantities of C, N, Si, Ni and Cr are different. Thus, in the austenite stainless steel of the type of SUS 304 and SUS 316 (including L, N and LN grades) the recrystallization temperature is determined by the quantity of Mo so that by completing rolling at a temperature higher than $T_R=940+30(\%\ Mo)$, it is possible to obtain steel having a structure containing recrystallized uniform fine grains. The reason that Mo has much larger effect of preventing recrystallization is caused by misfit with Fe atoms of steel comprising the base metal. More particularly, atoms of Si, Mn, Cr and Ni have the same radius as those of steel, but the radius of molecules of Mo is much larger than that of steel atoms. As a consequence, the degree of misfit is large so that the solute drag effect increases which contributes to the remarkable effect of preventing recrystallization. Since C and N are penetrating type elements, it can be considered that their influence is small.

The recrystallized structure obtainable by completing the rolling operation at a temperature higher than $T_R=940+30(\%\ Mo)$ has much finer grains than the prior art stainless steel subjected to solid solution treatment, so that high tensile strength can be obtained due to fine grain structure.

Figure 2:
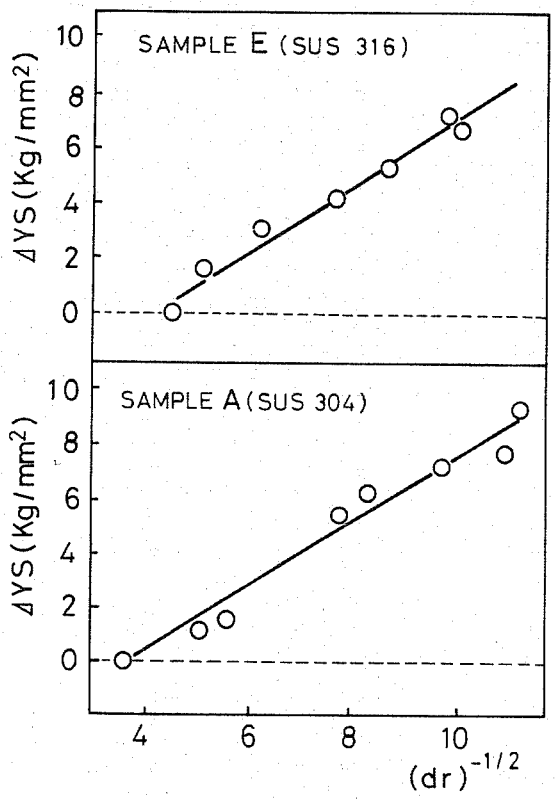
FIG. 2 are graphs showing the relation between the $\gamma$ particle diameter and steels to be subjected to the solution treatment when SUS 304 and SUS 316 steels are rolled under various rolling conditions that satisfy the finishing rolling temperature in a range defined by this invention.

FIG. 2 shows the difference between the $\gamma$ particle diameter (dr) of SUS 304 (sample A) and SUS 316 (sample E) which are rolled under various rolling conditions that satisfy a rolling temperature $\geqq T_R$(°C.) which is the recrystallization condition according to this invention, and the yielding strength (YS) of stainless steel subjected to solution treatment (1050° C., 30 min.). In each case, it can be noted that as the $\gamma$ particle size decreases so that $(dr)^{-\frac{1}{2}}$ increases, the difference $\Delta YS$ of the yielding strength (YS) with reference to stainless steel subjected to solution treatment increases, thereby increasing the tensile strength. As the grain size is decreased, tensile strength of a maximum of 10 kg/mm$^2$ can be obtained.

The cooling conditions effective to suppress precipitation of nitride and carbide of chromium in the grains were judged by simulating a rolling operation by using a high pressure compressing testing machine, in which test pieces were cooled at various cooling speeds, and then the test pieces were electrolytically etched (current density of 1A/dm$^2$, 90 sec.) with a 10% oxalic acid solution. The following Table II shows the presence or absence of precipitated particles when sample steel A was heated to 1200° C., reduced by 20% at temperatures of 1000° C. and 950° C., respectively to obtain a fine crystal structure, cooled at a speed of 0.8° C./sec. corresponding to the air cooling speed of steel stock having a thickness of about 20 mm before commencing the accelerated cooling, and then cooled at various cooling conditions (cooling speed, commencement and stopping cooling).

TABLE II

| condition | cooling starting temp. (°C.) | cooling stopping temp. (°C.) | cooling speed (°C./sec) | precipitation |
|---|---|---|---|---|
| 1 | 800 | RT | 10 | NO |
| 2 | 800 | RT | 5 | NO |
| 3 | 800 | RT | 3 | YES |
| 4 | 800 | RT | 1 | YES |
| 5 | 800 | 450 | 5 | NO |
| 6 | 800 | 500 | 5 | NO |
| 7 | 800 | 550 | 5 | YES |
| 8 | 800 | 600 | 5 | YES |
| 9 | 700 | 500 | 5 | YES |
| 10 | 750 | 500 | 5 | YES |
| 11 | 850 | 500 | 5 | NO |

Comparison of conditions 1 to 4 shows that it is necessary to cool at a speed higher than 5° C./sec., and comparison of condition 1 with conditions 5–8 shows that the cooling stopping temperature should be 500° C. or below. When the cooling is terminated at 550° C. or 600° C., precipitation occurs during air cooling (in this experiment it was simulated at a cooling speed of 0.8° C./sec.) subsequent to the accelerated cooling. The cooling termination temperature may be any temperature so long as it is 500° C. or below. When the termination temperature is low, strain is produced in the steel stock, so that about 500° C. is preferred. As can be noted from the comparison of condition 6 with conditions 9–11, the cooling starting temperature should not be less than 800° C. When the cooling starting temperature is 750° C. or 700° C. precipitation occurs.

Figure 3:
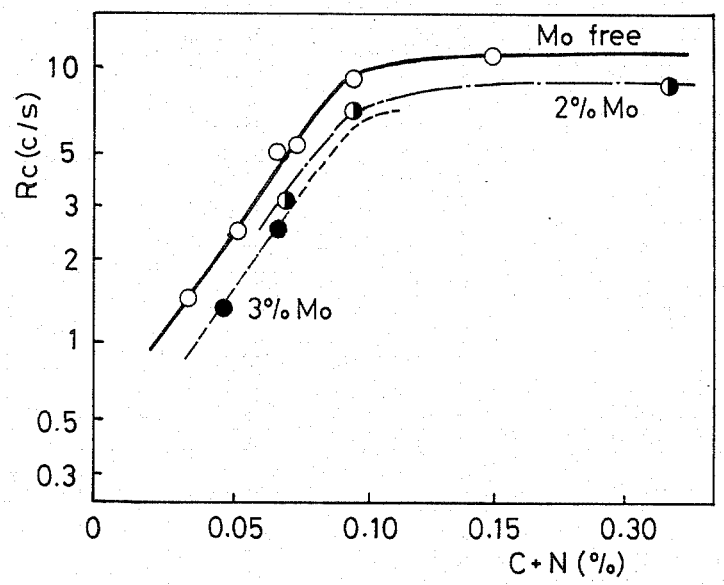
FIG. 3 is a graph showing the relation between quantities of (C+N) and Mo when various steel samples are heated to 1200° C., then rolled by 20% and 15% respectively at 1100° C. and 1050° C., cooled to 800° C. at a rate of 0.8° C./sec. and then subjected to accelerated cooling.

The result of investigation of the test results shows that where the sample A (SUS 304) is rolled in a recrystallization range, in order not to cause the carbide and nitride of Cr to precipitation, it is necessary to effect accelerated cooling at a high speed larger than 5° C./sec. in a range of higher than 800° C. and below 500° C. Since it is considered that the critical cooling speed varies depending upon the quantities of C, N and Mo, we have made the following investigations. Thus, FIG. 3 shows the relationship between the quantities of (C+N) and Mo and the critical cooling speed when samples A, C, D and F shown in Table I and samples G–M shown in the following Table II are heated to 1200° C., reduced by 20% and 15% respectively at 1100° C. and 1050° C., cooled to 800° C. at a speed of 0.8° C./sec. and then cooled rapidly.

TABLE III

| | COMPOSITION OF TEST STEEL | | | | | | | | | |
|---|---|---|---|---|---|---|---|---|---|---|
| | C | Si | Mn | P | S | Ni | Cr | Mo | sol. Al | TN |
| G | 0.010 | 0.53 | 1.03 | 0.015 | 0.008 | 10.3 | 18.5 | — | 0.002 | 0.0231 |
| H | 0.028 | 0.52 | 1.12 | 0.016 | 0.009 | 9.3 | 18.5 | — | 0.001 | 0.0238 |
| I | 0.051 | 0.48 | 1.04 | 0.015 | 0.008 | 8.8 | 19.3 | — | 0.001 | 0.0250 |
| J | 0.076 | 0.43 | 1.03 | 0.014 | 0.007 | 9.3 | 18.8 | — | 0.002 | 0.0203 |
| K | 0.011 | 0.42 | 0.96 | 0.012 | 0.008 | 12.8 | 17.4 | 3.0 | 0.001 | 0.0351 |
| L | 0.075 | 0.38 | 1.14 | 0.020 | 0.008 | 12.8 | 17.5 | 2.1 | 0.001 | 0.0236 |
| M | 0.010 | 0.52 | 1.54 | 0.013 | 0.006 | 9.5 | 19.3 | — | 0.002 | 0.143 |

In a sample not containing Mo, in a range of $(C+N) \leqq 0.10$ wt. %, the critical cooling speed increases with the quantity of (C+N), but in a range of $(C+N) > 0.10$ wt. % the critical cooling speed is substantially constant, that is 10° C./sec. For the same quantity of (C+N), as the quantity of Mo increases the critical cooling speed decreases, but when depicted with logarimithic scale the critical cooling speed is constant irrespective of the quantity of (C+N). Consequently, the critical cooling speed is given by the following equations.

$$\log (Rc) = -0.32 + 14(\%\ C + \%\ N) - 0.067(\%\ Mo)$$

when $(C+N) \leqq 0.10$; and $$\log (Rc) = 1.08 - 0.067(\%\ Mo)$$

when $(C+N) > 0.10$.

In other words, the element having a large influence upon the recrystallization temperature is Mo, and with regard to the critical cooling temperature at which Cr precipitates, the influences of C and N are most significant followed by Mo. The influence of other elements are extremely small.

In this invention the reason of limiting the composition is as follows.

With reference to C, as shown in FIG. 3, it is necessary to limit its quantity to be 0.08 wt. % or below. Although Si is necessary for deoxidization, when its quantity exceeds 1.0 wt. % it will greatly degrade hot workability, so that its maximum quantity should be 1.0%.

Mn is also necessary for deoxidization. When its quantity exceeds 2.0 wt. % it degrades corrosion proofness so that its upper limit is 2.0%.

Cr is an important element for improving corrosion proofness especially for improving pitting resistant property, but when this quantity is less than 16% its advantageous effect can not be sufficiently obtained. However, when the quantity of Cr exceeds 20% it becomes necessary to incorporate a large quantity of Ni in order to assure the austenite structure, thus increasing the cost and decreasing workability. For this reason, it is necessary to maintain the quantity of Cr in a range of from 16 to 20 wt. %. Ni is effective to improve corrosion proofness and it is necessary to use Ni in an amount of 8.0% or larger for the purpose of maintaining the austenite structure with the quantity of Cr maintained in the range described above. However, owing to an economical reason, the upper limit of Ni should be 16%.

Mo is effective to improve corrosion proofness, but use of Mo more than 30% is uneconomical so that 30% is its upper limit. The content of Mo may be 0%.

N is effective to improve corrosion proofness, but use of N larger than 0.25% is disadvantageous because it increases hardness.

Thus, by heating austenitic stainless steel containing specified composition in the ranges as above described and the reminder of iron and inherent impurities, by rolling the stainless steel at a temperature higher than $T_R = 940 + 30(\%\ Mo)$, and by taking into consideration (C+N) cooling the rolled stainless steel from above 800° C. to below 500° C. at a critical cooling speed (Rc) expressed by:

$$\log (Rc) = -0.32 + 14(\%\ C + \%\ N) - 0.067(\%\ Mo)$$

when $(C+N) \leqq 0.10$; and $$\log (Rc) = 1.08 - 0.067(\%\ Mo)$$

when $(C+N) > 0.10$, it is possible to manufacture, in a single production line, stainless steel having the same or larger corrosion proofness and much higher yield strength than that subjected to a prior art solution treatment.

Concrete examples of the method of this invention are as follows.

The following Table IV shows the mechanical characteristics of SUS 304 steel containing 0.048% of C, 0.50% of Si, 0.96% of Mn, 9.2% of Ni, 18.9% of Cr and 0.332% of N after it is passed through a blooming mill, heated to 1100° C., and then subjected to various heat treatment, presence or absence of precipitation detected by 10% oxalic acid electrolytic etching, and the result of dipping test (6 hours in 0.5% boiling sulfuric acid).

TABLE IV

| | condition | | | | | | |
|---|---|---|---|---|---|---|---|
| sample | rolling finishing temp. (°C.) | cooling speed (°C./sec.) | YS (kg/mm²) | TS (kg/mm²) | corrosion* | quantity of corrosion** (g/mm²) | remark |
| 1 | solution treatment 1050° C. water quench. | | 21.1 | 58.3 | NO | 4.8 | control |
| 2 | 1000 | 7 | 26.3 | 63.8 | NO | 4.7 | this invention |
| 3 | 950 | 10 | 30.3 | 66.4 | NO | 4.6 | this invention |
| 4 | 900 | 7 | 52.1 | 71.3 | YES | 10.3 | control |

TABLE IV-continued

| sample | condition: rolling finishing temp. (°C.) | cooling speed (°C./sec.) | YS (kg/mm²) | TS (kg/mm²) | corrosion* | quantity of corrosion** (g/mm²) | remark |
|---|---|---|---|---|---|---|---|
| 5 | 950 | 4 | 31.0 | 66.3 | YES | 6.4 | control |

*10% oxalic acid electrolytic etching process
**dipping test in 0.5% boiling sulfuric acid The steel plate had a thickness of 12 mm, a recrystallization temperature of $T_R=940°$ C., a critical cooling speed of Rc=6.6° C./sec., an acceleration cooling commencing temperature of 800° C. and cooling termination temperature of 500° C.

The conditions shown in Table IV are similar to those utilizing solid solution treatment in that there is no precipitation and the quantity of corrosion is substantially the same. However, the yielding strength (YS) has increased by 5–9 kg/mm² due to miniaturization of grain size. Although not shown in Table IV, since according to this invention, the acceleration cooling is effected in the same production line, when compared with the solution treatment, the reheating step can be omitted, thus saving cost of installation and energy.

The conditions 4 shown in Table IV do not satisfy the recrystallization condition of this invention, so that a portion of the steel stock does not undergo recrystallization, thus increasing corrosion notwithstanding of its large intensity. This can be attributed to residual working strain that affects corrosion proofness caused by not recrystallized state. Since conditions 5 shown in Table IV do not satisfy the critical cooling speed of this invention, precipitatation occurs, and the quantity of corrosion is slightly higher than the stainless steel of this invention.

The following Table V shows the mechanical characteristics, presence or absence of corrosion, and result of test of 0.5% boiling sulfuric acid immersion of SUS 316L, that is stainless steel containing 0.019% of C, 0.55% of Si, 1.32% of Mn, 13.6% of Ni, 17.4% of Cr, 2.5% of Mo and 0.0288% of N which was cast continuously into a slab, subjected to light blooming rolling, heated to 1250° C., and then subjected to various heat treatments.

The test pieces had a plate thickness of 5 mm, the recrystallization temperature $T_R$ was 1015° C., and the critical cooling speed Rc was 1.5° C./sec. The acceleration cooling was started at a temperature of 800° C., and terminated at 500° C. which are the same as in Table IV.

The sample 2 shown in this table and embodying the method of this invention has no corrosion and the quantity of corrosion is similar to the control sample 1 subjected to the solution treatment but the yielding strength (YS) has increased by 8.7 kg/mm². However, those of samples 3 and 4 do not satisfy the recrystallization and the critical cooling condition respectively so that their corrosion proofness is inferior than samples of this invention and of the control.

As shown in Table V, when the recrystallization temperature is relatively high and the finished plate thickness is relatively small, it is difficult to assure a desired finishing temperature. In such case, it is advantageous to subject slabs to light rolling operation to decrease their thickness.

As above described, according to this invention, energy can be greatly saved than the solution treatment, usually relied upon to obtain austenitic stainless steel plates. Moreover, much higher yielding strength (YS) than the conventional solution treatment can be obtained.

What is claimed:

1. A method of manufacturing austenitic stainless steel plates containing up to 0.08 wt. % of carbon, up to 1.0 wt. % of silicon, up to 2.0 wt. % of manganese, 8.0–16.0 Wt. % of nickel, 16.0–20.0 wt. % of chromium, 0–30 wt. % of molybdenum, up to 0.25 wt. % of nitrogen and the balance of iron and inherent impurities, the method comprising the steps of:

rolling a stainless steel blank at a temperature higher than $T_R=940+30$ (% Mo); and then cooling the rolled blank from a temperature above 800° C. to a temperature below 500° C. at a cooling speed higher than Rc (°C./sec.) shown by the following equations:

$$\log(Rc)=-0.32+14(\%\ C+\%\ N)-0.067(\%\ Mo)$$

when (% C+% N)≦0.1 wt. %; and $$\log(Rc)=1.08-0.067(\%\ Mo)$$

when (% C+% N)>0.1 wt. %.

* * * * *

TABLE V

| sample | condition: rolling finishing temp. (°C.) | cooling speed (°C./sec.) | YS (kg/mm²) | TS (kg/mm²) | corrosion* | quantity of corrosion** (g/m²) | remark |
|---|---|---|---|---|---|---|---|
| 1 | solution treatment 1050° C. water quench. | | 23.3 | 59.4 | NO | 1.6 | control |
| 2 | 1050 | 4 | 32.0 | 63.4 | NO | 1.5 | this invention |
| 3 | 950 | 4 | 50.3 | 70.8 | NO | 3.5 | control |
| 4 | 1030 | 0.8 | 32.8 | 64.0 | YES | 2.2 | control |

*10% oxalic acid electrolytic etching process
**dipping test in 0.5% boiling sulfuric acid